US006676248B1

(12) United States Patent
Hollands

(10) Patent No.: US 6,676,248 B1
(45) Date of Patent: Jan. 13, 2004

(54) CHANNEL STRUCTURE FOR AN INK JET PRINTHEAD

(75) Inventor: Peter Joseph Hollands, Baarlo (NL)

(73) Assignee: Oce-Technologies B.V., MA Venlo (NL)

( * ) Notice: Subject to any disclaimer, the term of this patent is extended or adjusted under 35 U.S.C. 154(b) by 133 days.

(21) Appl. No.: 09/645,598

(22) Filed: Aug. 25, 2000

(30) Foreign Application Priority Data

Aug. 27, 1999 (EP) ..... 99202779

(51) Int. Cl.[7] ..... B41J 2/045
(52) U.S. Cl. ..... 347/70
(58) Field of Search ..... 347/68, 70, 71, 347/72

(56) References Cited

U.S. PATENT DOCUMENTS 6,336,717 B1 * 1/2002 Shimada et al. ..... 347/71

FOREIGN PATENT DOCUMENTS

| | | |
|---|---|---|
| EP | 0737585 A1 | 10/1996 |
| EP | 0761447 A2 | 3/1997 |
| EP | 0820869 A1 | 1/1998 |
| EP | 0919383 A2 | 6/1999 |
| JP | 141853 | 3/1997 |

* cited by examiner

*Primary Examiner*—Judy Nguyen
(74) *Attorney, Agent, or Firm*—Birch, Stewart, Kolasch & Birch, LLP

(57) ABSTRACT

A channel structure for an ink jet printhead has a channel plate containing a plurality of substantially equidistant ink channels formed in one surface thereof defining dams between the adjacent ink channels. A diaphragm extending over the plurality of ink channels. A plurality of spacers disposed between the diaphragm and the channel plate for supporting the diaphragm on the dams. And actuators operatively associated with the diaphragm above the ink channels on the opposite side of the diaphragm from the spacers.

3 Claims, 2 Drawing Sheets

CHANNEL STRUCTURE FOR AN INK JET PRINTHEAD

BACKGROUND OF THE INVENTION

The present invention relates to a channel structure for an ink jet printhead comprising a channel plate having a plurality of substantially equidistant ink channels formed in one surface thereof, with dams being formed between the adjacent channels, wherein each channel is covered by a portion of a diaphragm supported on said dams and deflectable into the channel by means of an actuator operatively associated therewith.

An example of an ink jet printhead having such a channel structure is disclosed in EP-A-0 820 869. The ink channels are arranged side-by-side and are each connected to a nozzle, so that the nozzles form a linear array with constant spacings between adjacent nozzles. When an actuator associated with one of the ink channels is activated, the portion of the diaphragm engaged by this actuator is deflected into the ink channel, so that the liquid ink contained in this ink channel is pressurized, causing ink droplets to be expelled from the nozzle. The diaphragm portions covering the individual ink channels are formed by a continuous flexible plate which is superimposed on the channel plate and is formed with bumps on the side facing away from the channel plate. The actuators engage only the bumps of the diaphragm, so that the deflection behavior of the diaphragm is improved. In order to optimize the deflection properties of the diaphragm, each bump should be disposed exactly in the widthwise center or middle of the deflectable portion.

Applicant's co-pending European Patent Application No. 98 200 190 relates to an ink jet printhead in which the diaphragm has a two-layer structure, and the bumps are interposed between the two layers.

In the prior art channel structures the diaphragm has a smooth surface on the side facing the channel plate and is in face-to-face engagement with the top surfaces of the dams separating the individual ink channels. Thus; the position and width of the deflectable portion of the diaphragm is determined by the shape and position of the ink channel in the channel plate. In order to obtain a uniform performance of the various ink channels in terms of drop generation, it is essential that the ink channels are formed in the channel plate with high accuracy, so that only very small manufacturing tolerances can be allowed. As a result, a manufacturing process satisfying these low tolerances is required, and this gives rise to increased manufacturing costs.

SUMMARY OF THE INVENTION

It is an object of the present invention to allow for greater manufacturing tolerances in the production of the channel plate without causing deterioration in the uniformity of the drop generation processes in the various ink channels.

This object is achieved by a channel structure wherein the diaphragm is supported on the dams through spacers which define the exact width and position of the deflectable portion of the diaphragm.

Thus, according to the present invention, only the spacers need to be formed with high positional accuracy in order to ensure a correct positional relationship between these spacers and the actuators or bumps. As a result, the channel plate itself may be manufactured with greater tolerances and, accordingly, at lower costs.

Less strict tolerance requirements will generally lead to considerable cost savings, regardless of the process employed for forming the ink channels. In addition, it becomes possible to employ more economic manufacturing processes, such as molding processes, which heretofore have not been acceptable because they could not satisfy the tolerance requirements.

It should be observed that, of course, the nozzles to which each ink channel is connected must be formed with high accuracy. This requirement can, for example, be fulfilled by forming the nozzles in a separate nozzle plate which is then attached to a front face of the channel plate. But even when the nozzles are formed in the channel plate itself, this does not mean, that the level of accuracy required for the nozzles must also be required for the ink channels in their entirety. For example, the ink channels may be formed as grooves cut into the surface of the channel plate with comparatively large tolerances and spaced away from the front face of the nozzle plate in which the nozzles are to be formed. Then, the nozzles may be formed with higher accuracy in a separate manufacturing step, e.g. by laser cutting or the like.

In a preferred embodiment the spacers are formed in one piece with the diaphragm. For example, the diaphragms covering all the ink channels may be formed by a continuous metal foil in which a pattern of grooves and ridges is formed, e.g. by etching, whereby the ridges form the spacers and the thinner bottom portions of the grooves form the flexible portions of the diaphragm. Optionally, bumps to be engaged by the actuators may be formed on the opposite side of the metal foil. Since the metal foil is relatively thin and, correspondingly, the amount of material to be removed by etching or the like is rather small, the increase in manufacturing costs caused by the processing of the metal foil is much smaller than the cost savings achieved in manufacturing the channel plate.

As an alternative, the spacers may also be formed by a separate grid-like member interposed between the diaphragm and the channel plate. The spacers may also be formed in one piece with the channel plate. In this case, the ink channels may at first be formed with a width slightly smaller than the nominal width, so that large tolerances can be allowed. Then, the top surfaces of the dams separating the ink channels may be processed in a more accurate second step in which only small amounts of material are removed from the edges of the dams, e.g. by laser cutting, in order to form the spacers.

BRIEF DESCRIPTION OF THE DRAWINGS

Embodiments of the present invention will now be described in conjunction with the drawings in which.

DETAILED DESCRIPTION OF THE INVENTION

Figure 1:
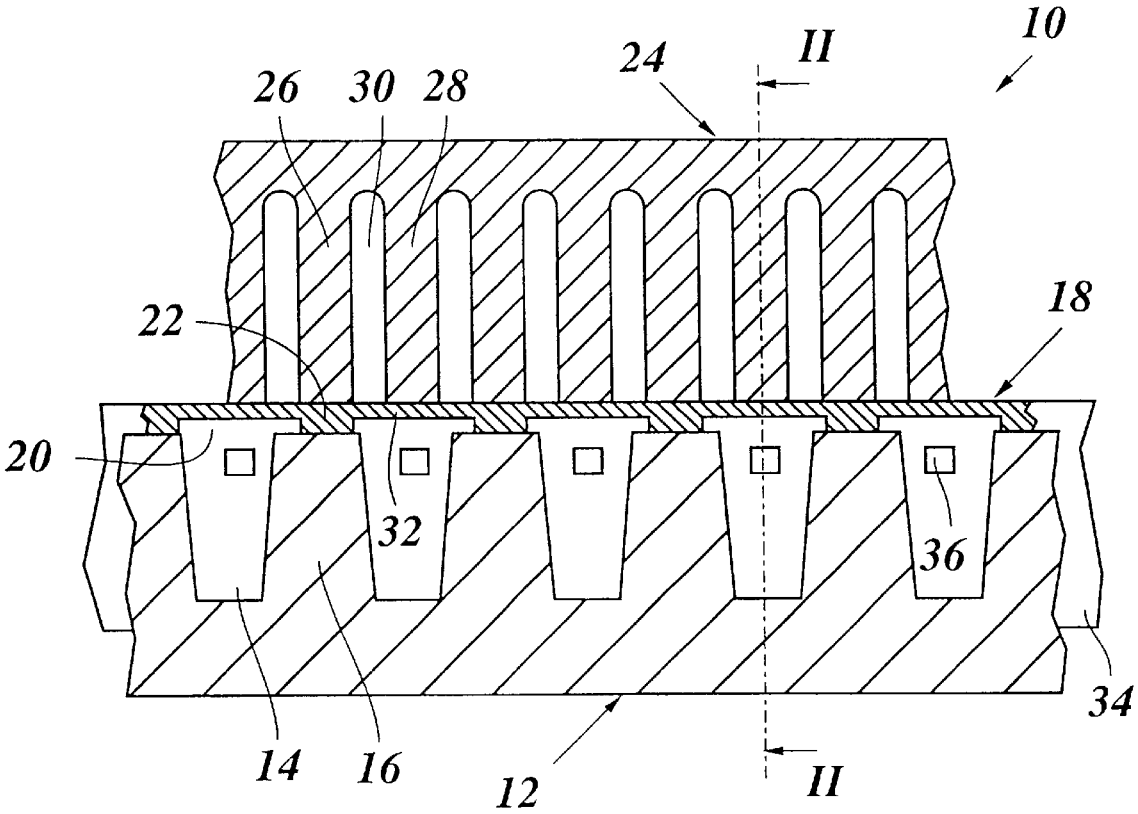
FIG. 1 is a cross-sectional view of a channel structure according to a first embodiment of the present invention.

As is shown in FIG. 1, a channel structure for an ink jet printhead 10 comprises a channel plate 12 made, for example, of ceramics, graphite, a synthetic resin or the like. In the case of a printhead for hot melt ink, the material of the channel plate should have a sufficient heat conductivity. A plurality of ink channels 14 are formed in the top surface of the channel plate 12 by any suitable process such as cutting, milling, or, more preferably, by molding. A dam 16 is left between each pair of adjacent ink channels 14.

A diaphragm 18 is disposed on the top surface of the channel plate 12, i.e., on the surface defined by the top surfaces of the dams 16. The diaphragm 18 may be formed for example by a metal foil such as a foil of Ni, Co. or the like or an alloy of these metals, or a sheet of silicon, plastic or glass or the like. The lower surface of the diaphragm 18 facing the channel plate 12 is provided with a regular pattern of grooves 20 separated by downwardly projecting spacers 22. The pattern of grooves 20 and spacers 22 corresponds to the pattern of ink channels 14 and dams 16, so that each spacer 22 is supported on the top surface of one of the dams 16.

An actuator block 24 made of piezoelectric ceramic is bonded to the top surface of the diaphragm 18 which, in this embodiment, is a flat surface. The actuator block 24 has a comb structure of alternating support portions 26 and actuators 28 separated by relatively deep grooves 30. The lower end of each support portion 26 is connected to a portion of the diaphragm 18 which is directly opposite to a spacer 22, and the lower end of each actuator 28 is bonded to the widthwise center of a thinner deflectable portion 32 of the diaphragm 18 disposed between two adjacent spacers 22.

Figure 2:
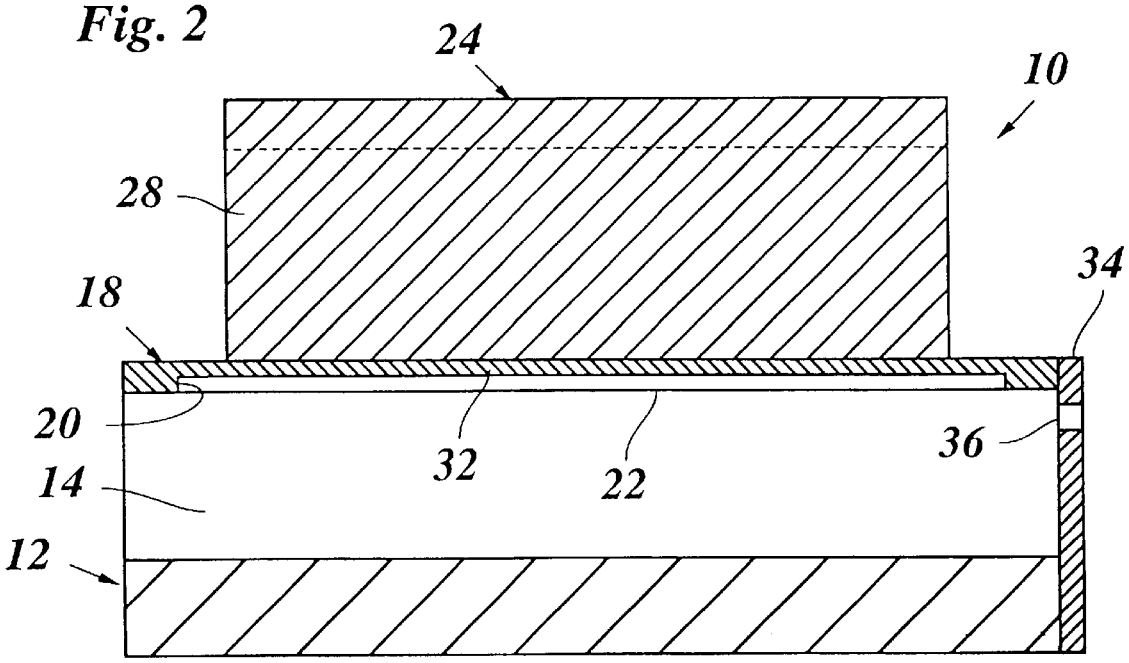
FIG. 2 is a section taken along the line II—II of FIG. 1.

As is shown in FIG. 2, the ink channels 14 formed in the channel plate 12 are open at both ends, but a nozzle plate 34 is attached to the front face of the channel plate so as to block the open ends of the ink channels 14. The nozzle plate 34 has a plurality of orifices which define a nozzle 36 within each of the ink channels 14. The open opposite end of each ink channel is connected to an ink supply system which is not shown in the drawings.

As is generally known in the art, each of the piezoelectric actuators 28 is provided with electrodes (not shown), and by energizing these electrodes, the actuator can be caused to expand and retract, so that the corresponding portion 32 of the diaphragm 18 is flexed into the associated ink channel 14 to pressurize the ink contained therein, whereby an ink droplet is expelled through the nozzle 36.

The ink droplets are deposited on an image recording medium, e.g., paper, so that an image can be printed by energizing the various actuators 26 in accordance with the image information. In order to obtain a good quality printed image, and, in particular, in order to achieve a smooth appearance of the uniformly colored block areas in the image, it is essential that the ink droplets expelled from the various nozzles 36 all have the same volume and are ejected with the same velocity. In other words, the performance of the various channels in the drop generation process should be as uniform as possible. In this respect, it is important that all the actuators 28 have the same dimensions, all the deflectable portions 32 of the diaphragm have the same width, and the positional relationship between the actuators 28 and the deflectable portions 32 of the diaphragm is the same for all ink channels.

In order to achieve these objectives, a high-precision cutting process is utilized for cutting the grooves 30 into the actuator block 24 in order to form the support portions 26 and the actuators 28. Likewise, a high precision process, e.g. an etching process, is utilized for forming the grooves 20 in the diaphragm 18 in the correct positions and with the correct dimensions. When the printhead is assembled, the actuator block 24 is accurately adjusted relative to the diaphragm 18, so that the support portions 26 coincide with the spacers 22 with high accuracy.

However, since the width dimensions of the various ink channels 14 do not determine the width of the deflectable portions 32 of the diaphragm, greater manufacturing tolerances can be allowed for the positions and width dimensions of the ink channels 14. Thus, as can be seen in FIG. 1, there may be considerable fluctuations in the positional relationship between the various dams 16 and the spacers 22. Likewise, the positional accuracy with which the diaphragm 18 is disposed on the channel plate 12 does not need to be as high as the accuracy required for assembling the actuator block 24 and the diaphragm 18. It may therefore be advantageous in the manufacturing process that, in a first step, the actuator block 24 and the diaphragm 18 are bonded together and the assembly thus obtained is then disposed on the channel plate 12 in a second step.

In a modified embodiment which is not shown in the drawings, bumps may be provided on the top surface of the diaphragm 18 at the widthwise center of each of the deflectable portions 32, so that the actuator portions 28 engage the diaphragm 18 only through these comparatively narrow bumps, as is described in EP-A-0 820 869. Then, greater tolerances may even be allowed in the positional relationship between the actuator block 24 and the diaphragm 18.

Figure 3:
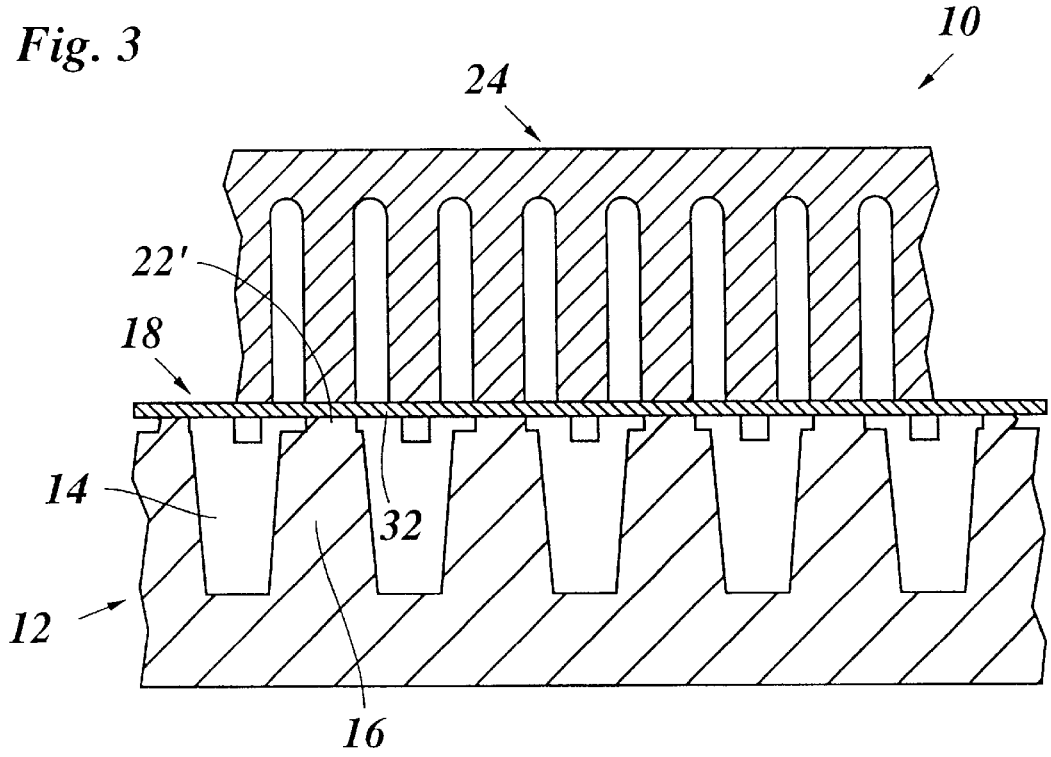
FIG. 3 is a cross-sectional view of a channel structure according to a second embodiment of the present invention.
Figure 4:
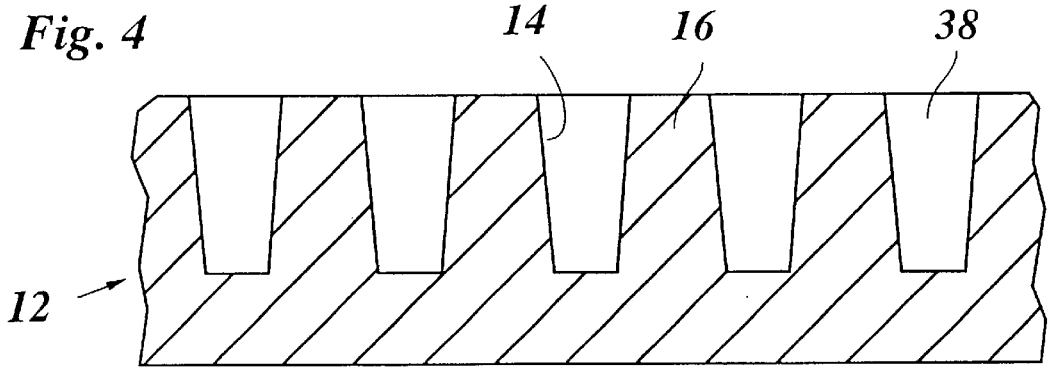
FIGS. 4 and 5 are cross-sectional views illustrating the manufacturing process for a channel plate according to the second embodiment of the present invention.
Figure 5:
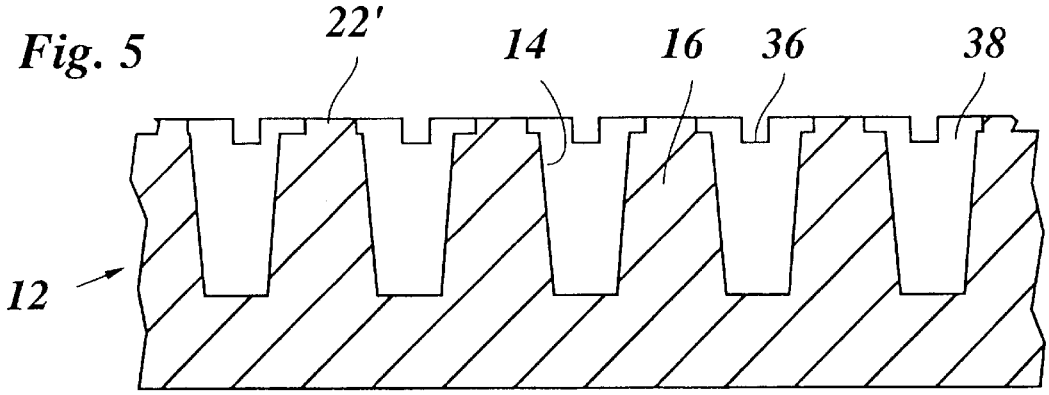

FIGS. 3 to 5 show a modified embodiment in which the diaphragm 18 has a uniform thickness and the spacers 22' defining the width of the deflectable portions 32 of the diaphragm are formed integrally with the dams 16 of the channel plate 12.

In a first manufacturing step illustrated in FIG. 4, the ink channels 14 are formed in the channel plate 12 with relatively poor accuracy. In this step, the level of the top surfaces of the dams 16 corresponds to the level of the top surfaces of the spacers 22' in FIG. 3.

In this embodiment, the ends of the ink channels 14 adjacent to the nozzles 36 are closed by a wall portion 38 of the channel plate.

In a subsequent manufacturing step illustrated in FIG. 5, the spacers 22' are formed with high accuracy by removing material of the channel plate 12 from the top longitudinal edges of the dams 16, e.g. by laser cutting. The nozzles 36 may be formed by removing material from the wall portions 38 in the same process.

While specific embodiments of the present invention have been described above, it will be understood that the invention is not limited to these embodiments but encompasses all possible modifications within the scope of the appended claims. In particular, the term "channel" used for the ink channels 14 should not be construed to exclude any specific geometric shape or length/width ratio of the ink channels.

What is claimed is:

1. A channel structure for an ink jet printhead comprising:

a channel plate containing a pattern of substantially equidistant ink channels formed in one surface thereof defining dams between the adjacent ink channels, a one-piece diaphragm having a same material throughout and extending over said plurality of ink channels, said one-piece diaphragm containing a pattern of grooves separated by projecting spacers which face the channel plate, said dams having surfaces substantially parallel to and facing said diaphragm, and actuators operatively associated with said diaphragm above said ink channels on the opposite side of said diaphragm from said channel plate, wherein in the channel structure the diaphragm is supported on the dams through said spacers such that only a part of said surfaces of the dams is in use for supporting the diaphragm.

2. The channel structure according to claim 1, wherein the one-piece diaphragm is formed by a metal foil having said grooves formed in the surface facing the ink channels in the channel plate.

3. The channel structure as claimed in claim 1, wherein the plate with the ink channels formed therein is a molded ceramic body.

* * * * *